United States Patent [19]

Logothetis

[11] 4,360,108

[45] Nov. 23, 1982

[54] METHOD AND APPARATUS FOR CHECKING LETTER THICKNESS

[75] Inventor: Emanuel N. Logothetis, Short Hills, N.J.

[73] Assignee: Joule' Technical Corporation, Union, N.J.

[21] Appl. No.: 222,390

[22] Filed: Jan. 5, 1981

[51] Int. Cl.[3] ..... B07C 5/34

[52] U.S. Cl. ..... 209/598; 209/603; 209/618; 209/900; 29/113 R; 73/37.7; 73/52

[58] Field of Search ..... 209/617, 618, 552, 598, 209/599, 600, 900, 603; 73/37.7, 52, 159; 29/113 R

[56] References Cited

U.S. PATENT DOCUMENTS

| | | | |
|---|---|---|---|
| 2,712,870 | 7/1955 | Geertsen | 209/618 |
| 3,319,784 | 5/1967 | Granger | 209/599 X |
| 3,589,714 | 6/1971 | Staples | 73/37.7 X |
| 4,031,741 | 6/1977 | Schaming | 73/37.7 |
| 4,075,739 | 2/1978 | Staheli | 73/37.7 X |
| 4,117,718 | 10/1978 | Hayward | 209/599 X |

*Primary Examiner*—Allen N. Knowles

*Attorney, Agent, or Firm*—Alexander C. Wilkie, Jr.

[57] ABSTRACT

A method and apparatus are described for automatically checking envelopes for objects which would interere with an automatic postal mail sorting operation. The envelopes are moved between inflated rollers and changes in the roller pressures caused by objectionable objects in the envelopes are detected to control an envelope diversion gate.

13 Claims, 3 Drawing Figures

1
2
3
4
5
6
7
8
9
10
11
12
13
14
15
16
17

METHOD AND APPARATUS FOR CHECKING LETTER THICKNESS

BACKGROUND OF THE INVENTION

This invention relates to improvements in the inspection and sorting of mail. More particularly it relates a method and means for detecting objects other than paper in sealed envelopes passing through a mailing sorting system such as an automatic computer controlled mail sorting system. The method and means detect the presence of alien contents in envelopes and remove the envelopes from the regular sorting line for further inspection or special handling.

The sorting of mail is now being done more and more by high speed computer controlled automatic machinery which routes mail to the proper channels for delivery. A rather serious problem which is on the increase involves the inclusion of bulky objects in mailed envelopes which cause trouble in the sorting process. One problem relates to the increased bulk of irregular shaped envelopes which interfers with automatic processing. Another problem is the possibility of damage to the items in the envelopes during automatic sorting operations which not only injures the item being mailed but which may also damage the mail sorting equipment. For example, glass, vials or bottles containing corrosive or other fluids may be broken so that the liquid is spread over and damages the sensitive sorting equipment. This results in an expensive repair and equally importantly in a lengthy shut down of the automatic sorting equipment. The method and means of the present invention performs an initial screening operation to detect the presence of foreign or alien objects in envelopes and includes a gate for removing objectionable envelopes from the automatic mail sorting line.

Accordingly, an object of the present invention is to protect automatic mail sorting systems.

Another object of the present invention is to provide a method and means of detecting foreign articles in envelopes.

Another object of the present invention is to provide a high speed and reliable system for detecting articles in envelopes passing through automatic sorting machinery.

Another object of the present invention is to provide a detecting machine which will pass relatively thick envelopes but which will remove envelopes containing items other than paper or sheet-like material.

Other and further objects of the present invention will become apparent upon an understanding of the illustrative embodiments about to be described, or will be indicated in the appended claims, and various advantages not referred to herein will occur to one skilled in the art upon employment of the invention in practice.

BRIEF DESCRIPTION OF THE DRAWINGS

A preferred embodiment of the invention has been chosen for purposes of illustration and description and is shown in the accompanying drawings, forming a part of the specifications, wherein.

DETAILED DESCRIPTION OF THE INVENTION

Figures 1, 2, 3:
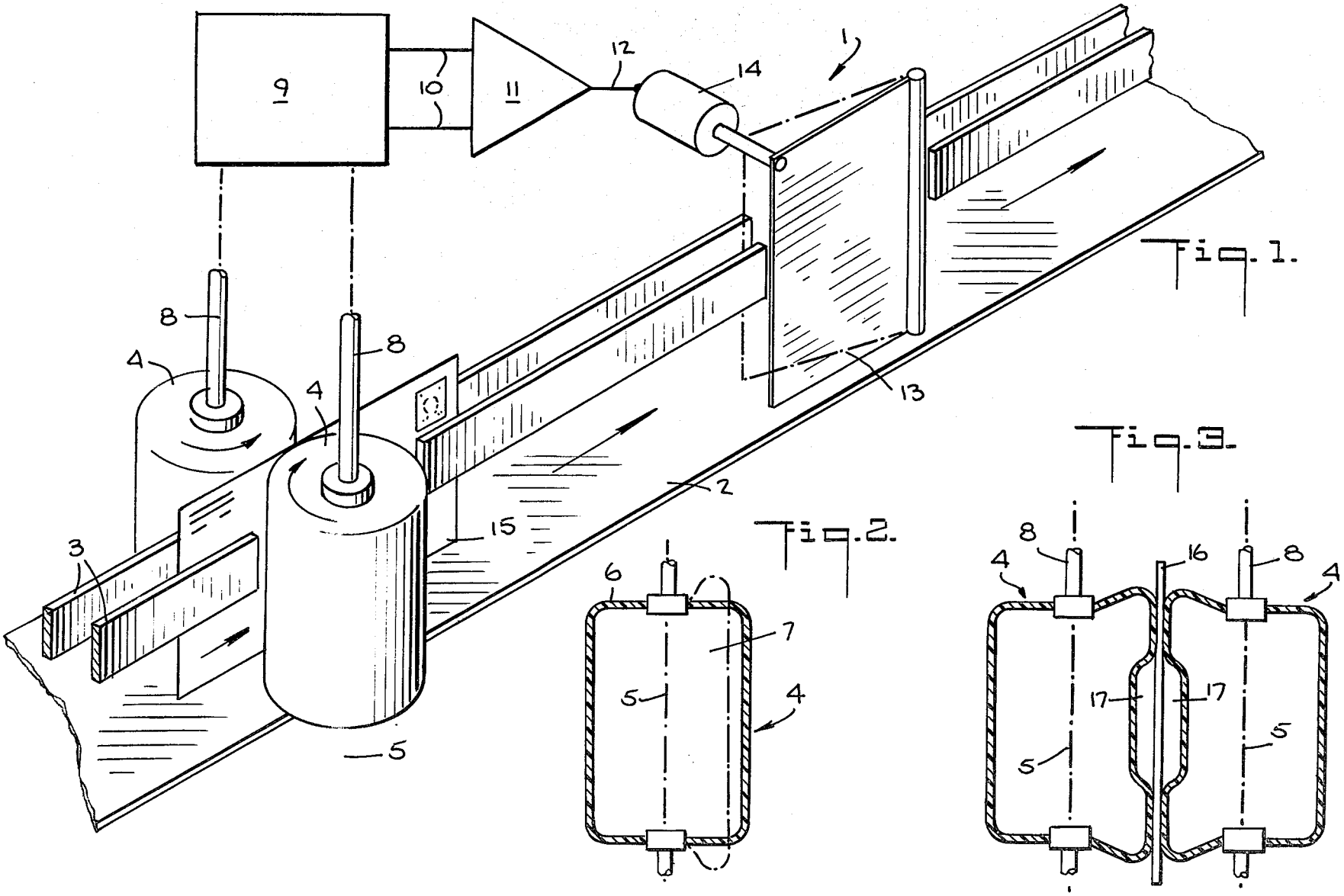
FIG. 1 is a perspective diagramatic view of the checking device in accordance with the invention.
FIGS. 2 and 3 are vertical sectional views of the checking rollers in accordance with the present invention.

The preferred apparatus in accordance with the present invention comprises means for feeding envelopes or generally similar packages through a contents checking station for the purpose of detecting changes in the thickness of the envelopes caused by the presence of articles other than paper or sheet-like material in the envelopes. As indicated above, this inspection is made at the entry end of a sorting system or separately before an automatic sorting system is employed.

The checking section 1 includes an envelope conveyor 2 with widely spaced guide rails 3 and a pair of rollers 4 mounted side by side with parallel axes 5. The rollers 4 have soft outer casings 6 (FIG. 2) which are filled with air 7 under pressure. The outer casings 6 are flexible and may be formed of rubber or plastic or other flexible and air impervious material. Air tubes 8 couple the rollers 4 to an air pressure meter 9 which provides voltage readings at outputs 10 corresponding to the air pressure changes in the two rollers 4. These outputs are fed to an amplifier 11 which provides an output control voltage at output 12 to operate the gate 13 by a solenoid 14. Thus, envelopes 15 which are objectionable, as described above, cause the gate 13 to be swung cross the guides 3 to divert the envelopes 15 with enclosed objects to a different collection point.

The exact arrangement of the pressure meter 9 and the amplifier 11 may be chosen to accord with the general nature of the envelope traffic being handled. The meter 9 may have separate sections each providing voltage outputs for one of the rollers 4. The amplifier 11 may be a summing amplifier whose output provides a control voltage for the roller pressure increases. The amplifier will include a threshold control so that the solenoid is activated only for a predetermined pressure increase.

Certain objectionable envelopes may be characterized by causing different pressures in the two rollers 4. In this case the amplifier 11 will be a differential amplifier to control the gate 13 as a result of reading certain predetermined pressure differentials.

Since thickness alone may not be objectionable while bumps or other irregularities may indicate objectionable enclosures, the rate of pressure change may be used to detect problem envelopes. In this case, the pressure meter will detect and indicate the rate of change of the roller 4 pressures. The amplifiers in this case may also be summing, or differential or simply direct amplifiers depending upon the characteristics of the envelope traffic being checked.

A trial testing of a number of typical envelopes will indicate the preferred arrangement of the pressure meter 9 and the control amplifier 11.

FIG. 3 shows an envelope 16 with a bulge 17 passing between rollers 4. In this case the adjacent rollers 4 tend to provide a self centering action on the envelope and the two rollers are deformed generally similarly resulting in a generally similar pressure build up in both rollers 4.

The pressure changes will generate an output signal with either a pressure change meter or a rate of change meter at the output 12 of a summing amplifier 11, and a command signal will be sent to the solenoid 14 to operate the envelope diverting gate 13.

In the case where the bulge is irregular so that it increases the pressure in only one roller 4, there will be a sharp increase in the pressure of only the one roller. The pressure meters in this case will receive generally differing indications of pressure change or rate of change so that a control signal is best generated by a differential amplifier. In this case the presence of the object causes the pressure change or rate of change to exceed the threshold allowed and the electrical control signal is sent to the solenoid 14 to swing gate 13 to divert the detected envelope. The passge of the envelopes through the rollers 4 releases the roller pressure to restore the gate 13 to its normal open position. A single pressure roller may be used with one detecting channel in combination with a cooperating soft back up roller in place of the other roller 4.

The inflated roller or rollers 4 in combination with the attached pressure meter and amplifier thus perform the desired selection function by detecting both bulky objects and irregular objects.

The sensing method therefore includes the steps of passing the envelopes between one or more inflated rollers and measuring the pressure changes in the rollers to create control signals for pressure changes greater than those caused by normal paper filled envelopes. The pressure differences or rates of change result from the presence of alien objects, i.e., objects other than paper or other sheet-like material in the envelopes being checked. The production of the control signals resulting from these differences are used to operate the envelope diversion or rejection means.

It will be seen that a relatively simple and effective method and means has been described for checking envelopes such as mailed envelopes for the presence of undesirable foreign objects. The use of the apparatus separately or at the beginning of automatic or semi-automatic mail sorting equipment protects both the mailed material and the sorting apparatus and personnel.

As various changes may be made in the form, construction and arrangement of the parts herein without departing from the spirit and scope of the invention and without sacrificing any of its advantages, it is to be understood that all matter herein is to be interpreted as illustrative and not in a limiting sense.

Having thus described my invention, I claim:

1. Envelope inspection means comprising the comination of inflated roller means, means for passing the envelopes past the roller means whereby the roller pressure varies with the envelope shape, and means for generating a control signal in accordance with the roller pressure change.

2. The inspection means as claimed in claim 1 in which the means for generating a control signal includes means making the control signal responsive to the rate of change of the roller means pressure.

3. The inspection means as claimed in claim 1 in which the means for generating a control signal includes means making the control signal responsive to the change of pressure in the roller means.

4. The envelope inspection means as claimed in claim 1 in which said roller means comprises a pair of rollers having parallel axes and contacting flexible surfaces.

5. The envelope inspection means as claimed in claim 1 in which said means to generate a control signal includes a differential amplifier.

6. The envelope inspection means as claimed in claim 1 in which said means to generate a control signal includes a summing amplifier.

7. The envelope inspection means as claimed in claim 1 which further comprises an envelope diverting gate operatively coupled to said means for generating a control signal.

8. A method of inspecting moving envelopes comprising the steps of passing the envelopes through an inflated envelope contacting means for varying the pressure of the contacting means in accordance with the envelope shape, detecting the change in the pressure of the contacting means caused by the passing envelopes, and generating a control signal responsive to the detected pressure changes.

9. The inspecting method as claimed in claim 8 which comprises the further step of changing the direction of the moving envelopes responsive to the generation of the control signal.

10. The inspecting method as claimed in claim 8 in which the pressure change detection includes detecting the rate of change of pressure.

11. The inspecting method as claimed in claim 8 in which the passing of the envelopes through a contacting means comprises passing the envelopes between a pair of inflated rollers.

12. The method as claimed in claim 11 in which the generating of a control signal includes forming a control signal based on the difference of the roller pressure.

13. The method as claimed in claim 11 in which the generating of a control signal includes forming a signal based on the difference of the rate of change of the roller pressures.

* * * * *